United States Patent [19]

Song

[11] Patent Number: 4,981,399

[45] Date of Patent: Jan. 1, 1991

[54] METHOD AND APPARATUS FOR INCREASING BEARING CAPACITY OF SOFT SOIL AND CONSTRUCTING CUTOFF WALL

[76] Inventor: Byongmu Song, 7836 Turquoise St., Dublin, Calif. 94568-3479

[21] Appl. No.: 439,257

[22] Filed: Nov. 20, 1989

[51] Int. Cl.[5] ..... E02D 5/20

[52] U.S. Cl. ..... 405/269; 405/270; 405/267; 405/263

[58] Field of Search ..... 405/269, 267, 266, 263, 405/270, 38, 45, 44, 43; 37/78, 76, 75, 62, 61

[56] References Cited

U.S. PATENT DOCUMENTS

| | | | |
|---|---|---|---|
| 965,895 | 8/1910 | Hardin | 405/45 |
| 4,102,145 | 7/1978 | Van Steveninck et al. | 405/269 X |
| 4,309,129 | 1/1982 | Takahashi | 405/269 |
| 4,601,612 | 7/1986 | Primrose | 405/269 X |
| 4,666,346 | 5/1987 | Macleod | 405/269 |
| 4,690,590 | 9/1987 | Nussbaumer et al. | 405/267 |
| 4,863,312 | 9/1989 | Cavalli | 405/267 X |

*Primary Examiner*—Dennis L. Taylor
*Assistant Examiner*—J. Russell McBee
*Attorney, Agent, or Firm*—Owen, Wickersham & Erickson

[57] ABSTRACT

A method and apparatus for forming a subsurface zone having an increased bearing capacity in a preselected area of relatively soft soil is disclosed. A liquefaction generator is provided in the form of a plurality of interconnected perforated pipes forming a grid pattern which substantially extends over the preselected area. Air and water under pressure are supplied to the liquefaction generator while allowing it to sink within the soft soil to a subterranean layer of hard soil or rock. The air and water are continually supplied to the generator until the soil above it is in a state of liquefaction and thereafter a hardenable material and/or rock fragments are added to the liquified soft soil above the generator. Thereafter, the mixed soil and added material is allowed to solidify over a period of time. For sites containing areas of compacted material, cutters may be attached to pipes of the liquefaction generator to further break up the soil material. The method may also be applied to the construction of subterranean cutoff walls with or without embedded, vertical, moisture impervious membranes.

15 Claims, 7 Drawing Sheets

METHOD AND APPARATUS FOR INCREASING BEARING CAPACITY OF SOFT SOIL AND CONSTRUCTING CUTOFF WALL

This invention relates to a method and apparatus utilizing the principle of an artificially induced condition of liquefaction for improving the bearing capacity of soft soil to provide the required support with an acceptable magnitude of settlement for subsequent surface structural and/or seismic loads, and for installing subsurface impervious cutoff walls.

BACKGROUND OF THE INVENTION

For many civil engineering projects the bearing capacity of existing soil on a building site must be increased in order to withstand the extreme weight of surface structures and also to minimize settling over a period of time. For example, in airport construction, proposed runway extensions often must extend into relatively soft or even marshy soil and such soil must be changed as to its bearing capacity before the runway surface can be installed. In other instances it often becomes necessary to form an impervious subsurface wall known as a cutoff wall in areas where the existing soil is relatively soft or marshy.

Various approaches to the aforesaid problem have been proposed by the prior art. In one previous approach, high permeability materials, such as columns of sand or artificial fabrics forming drain elements, were installed vertically at given intervals throughout the site to the entire depth of the soft soil in order to reduce moisture content of the soil which was responsible for producing settlement when structures were placed upon it. Subsequent to placing such vertical drains, a layer of sand and/or gravel was placed over the entire site. A surcharge in the form of a mound of soil was then placed over the area to provide added weight which tended to compress the soft soil. Water within the soft soil, which was now under pressure from the surcharge weight, gradually migrated to the adjacent vertical drains and was carried through them to the ground surface and eliminated. Accordingly, the moisture content of soft soil was slowly reduced. The surcharge load on the ground surface was maintained until the soft soil lost sufficient moisture content through the vertical drains and gained enough strength to provide the required bearing capacity and settlement characteristics. Use of such vertical drains in the construction industry started several decades ago. Some of the major examples of the use of such drain systems between 1954 through 1988 are described in the following articles:

(a) "Foundation and Fill Studies for the Metropolitan Oakland International Airport", Knappen-Tippetts-Abbett-McCarthy, Airport Consultant, New York, July 1954.

(b) "Soft Clay Engineering", pp 650–669, Elsevier Scientific Publishing company, New York, 1981.

(c) "Wicking Bay Mud", pp 53–55, Civil Engineering, American Society of Civil Engineering, December 1986.

(d) "Osaka International Airport", pp 53–60, October, 1988, Korean Society of Civil Engineering, Vol. 36, No. 5.

(e) "Hong Kong Replacement Airport", Journal of American Society of Civil Engineering, pp 87–146, Vol. 113, No. 2, February, 1987.

(f) "Settlement, Consolidation and Use of Wick Drains", Craig Shields, Harding-Lawson Assoc., Symposium on the Geotechnical and Hydrological Properties of San Francisco Bay Mud, Lafayette, Calif., May 13, 1989.

One serious disadvantage with the aforesaid procedure was that the time required to obtain the desired effect was highly sensitive to the original soil condition, the surcharge weight, and the vertical drain intervals. Normally, use of the vertical drain procedure required two years or more to achieve the desired effects and, frequently, the predicted settlement of the soft soil under the surcharge load on the surface was in error. Once the vertical drain elements and the surcharge load were installed, no construction activities on the site were possible until the required settlement had taken place. Often, readjustment of the predicted settlement was required on the basis of survey results. A waiting period of two years or more for settlement to cease was expensive. Similarly, the installation of an impervious subsurface cutoff wall or barrier by the methods of the prior art was time-consuming and expensive.

Summarizing, the prior art method for increasing the bearing strength of soft and wet soil utilizing vertical drains in conjunction with surface surcharge materials inherently required a gradual reduction of the moisture content of soft soil, a process which required several years to complete due to the very low coefficient of permeability. Secondly, the gain of strength was primarily measured by the magnitude of measured settlement. The settlement rate was predicted on the basis of laboratory consolidation test results, which almost never agreed with the actual conditions at the site, and thus required a modification of the entire program. Lastly, after the protracted procedures of the prior method, the improved site still contained the original soft soil, although with a reduced moisture content and increased strength. However, the site was still subject to long-term settlement, and was also more susceptible to deformation during and after seismic activities.

A problem similar to that of increasing the bearing strength of soft soil is that of providing a subsurface cutoff wall in certain soft soil locations. In some instances where the soil mixture within a slotted wall construction is semi-fluid, a membrane or diaphragm may be lowered into the slotted wall to form an impervious barrier. As shown in U.S. Pat. No. 4,690,590, the movement of such a membrane downward through the soil may be increased by use of air bubbles supplied at the bottom of the membrane. The air bubbles serve to reduce the viscosity and thus the shearing stress in the boundary layer along the sides of the membrane. However, this patent provided no solution to the problem of creating a hardenable subsurface slotted or cutoff wall.

SUMMARY OF THE INVENTION

It is therefore a general object of the present invention to provide a method and apparatus for increasing the bearing capacity of relatively soft soil that will overcome the disadvantages of the prior art method and greatly reduce the time required for achieving the desired results.

Another object of the invention is to provide a method for increasing the bearing capacity of soft soil that can be performed utilizing readily available construction equipment and which is therefore relatively inexpensive to implement.

Still another object of the invention is to provide an improved method for constructing a subsurface cutoff wall.

A more specific object of the invention is to provide a method for increasing the bearing capacity of soft soil or for constructing a subsurface cutoff wall wherein the soil of a preselected site is put in a liquified state by the use of pressurized water and air through a liquefaction generator and the liquified soil is thereafter supplied with solidifying materials such as rock fragments and/or chemical additives.

In accordance with the principles of the invention, a liquefaction generator is positioned on the surface of a defined area having the soft soil to be strengthened. The generator is preferably in the form of a network or grid of perforated pipes connected to separately controlled sources of air, water and chemical additives. Depending on the engineering characteristics of the soft soil, material quantities of air, water and/or dispersing chemicals are supplied at various times through the pipe network as the liquefaction generator descends through the soil and until it reaches a stable base of bed rock or the like. The soil above the buried network continues to be liquified. Dispersing chemical is supplied in a case where it is necessary to maintain the liquefied soft soil in a dispersed condition in order to facilitate the placement of rock fragments within the defined soil treatment area. At this point, rock fragments are deposited into the liquified zone until the entire thickness of the soft soil above the liquefaction generator is filled. Injection of dispersing chemical is stopped and cementing chemical agents are simultaneously supplied through the liquefaction generator until void spaces are filled between the rock fragments. The strengthened soil, now capable of relatively high bearing loads with only minimal settlement potential, can be ready for surface construction. Depending upon the site conditions and the design considerations, the site may be prepared with less stringent requirements. For instance, rock fragments could be deposited in the liquefied zone without the addition of subsequent cementing chemicals. Such a zone filled with the rock fragments could further be densified mechanically at the surface subsequent to the completion of the filling operation. In some other cases, cementing chemicals may be supplied to the liquefied zone to be mixed with the native materials and solidified without addition of the rock fragments.

The installation of subsurface cutoff walls may also be achieved by utilizing the principles of the present invention. Here, a plurality of liquefaction generator pipes connected in a pattern forming the length and width of the wall is lowered to a desired depth within the soft soil of the site where liquefaction takes place. Cementing agents, which are later solidified, are supplied into the liquefied zone. If an artificial impervious membrane is required by the design, a small liquefaction generator may be attached at the bottom edge of the membrane and lowered to a desired depth within the zone before the materials therein are solidified. In firmer soils, individual liquefaction generator pipes may be equipped with rotary cutting tools which are attached to the pipes on the surface and are driven by electric or hydraulic motors. The cutting tools operate as the generator pipes are lowered in the soil to insure the complete liquefaction of all material in the zone even if it contained areas of relatively harder material.

Other objects, advantages and features of the invention will become apparent from the following detailed description presented in conjunction with the accompanying drawing.

DETAILED DESCRIPTION OF EMBODIMENTS

Figure 1:
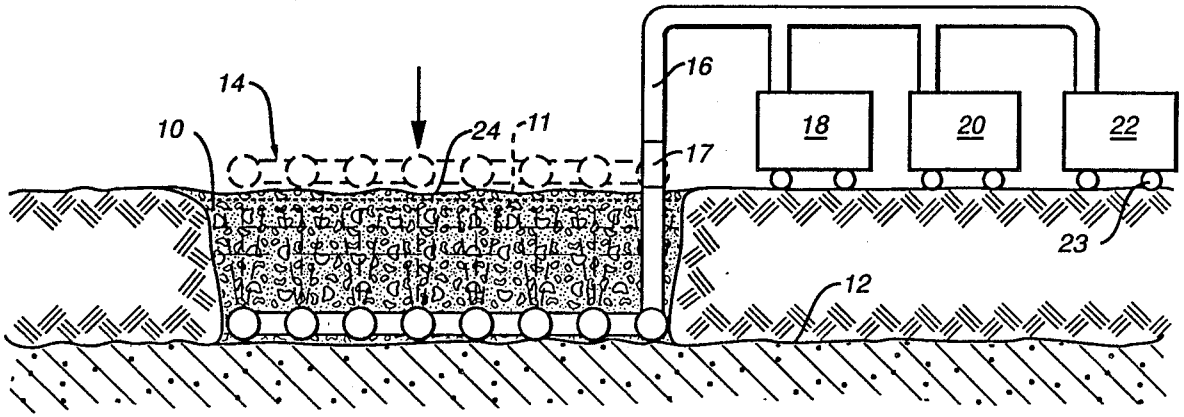
FIG. 1 is a schematic view in elevation and in section showing a liquefaction generator in its final position for use with respect to a site of soft soil in accordance with the invention, with its starting position shown in phantom.

With reference to the drawing, FIG. 1 shows schematically a site comprised of a surface layer 10 of soft soil whose inherent bearing capacity is relatively low and must therefore be increased by utilizing the method and apparatus of the present invention. Such a site could be, for example, a tidal area adjacent to an airport whose runway is to be lengthened, or any other similar area where soft soil exists above a lower layer 12 of hard soil or bed rock.

Figure 1A:
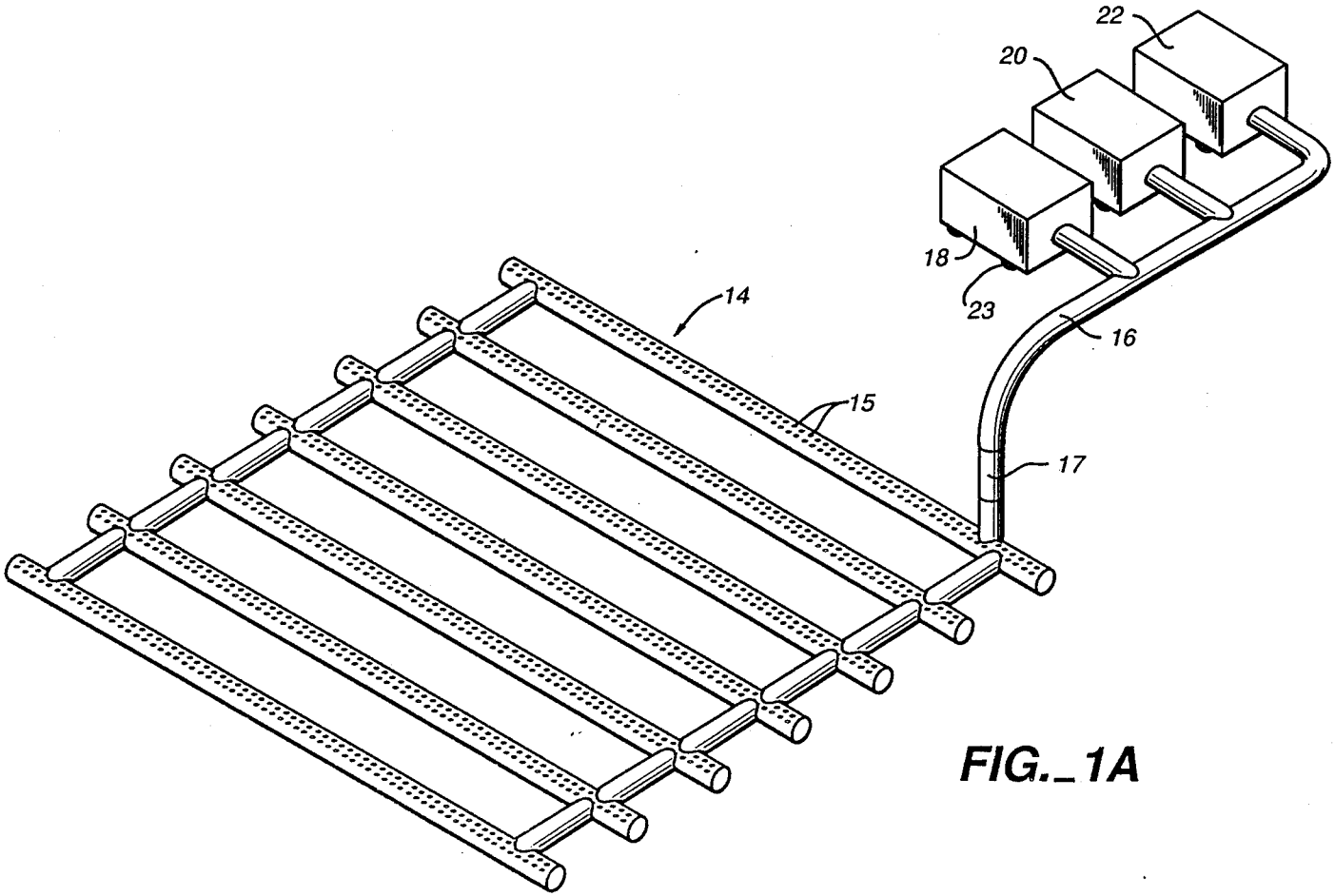
FIG. 1A is a view in perspective of a liquefaction generator embodying principles of the present invention, as shown in FIG. 1.

In accordance with the invention, a network 14 or grid of pipes is provided which is first placed on the surface of the soft soil in an area 11 to be treated. A typical piping network pattern is shown in FIG. 1A, which comprises a plurality of parallel spaced apart pipes connected together by conduits at each end. Other pipe network patterns can be devised to accommodate different types of soil and other conditions. The pipes of the network are perforated with small openings 15 along their surfaces and are connected to a common inlet 16 which may comprise one or more pipes, each of which has a longitudinally extendable section 17. The inlet is connected to a first supply tank 18 of water, a second tank 20 of compressed air and a third supply tank 22 containing chemical additives. Each tank has a suitable pump (not shown) for forcing metered amounts of water, air and chemical additives into the inlet 16 and thus into the pipe network at preselected rates. Also, each of the three tanks may be supported on wheels 23 so as to be easily movable into position for connection with the piping network 14.

As shown in FIG. 1, the method for strengthening the bearing capacity of the soft soil site commences when the piping network 14 is first positioned on the surface 24 of the soft soil site, as shown in phantom. The weight of the piping network will cause it to start sinking in the soft soil of the site. Now, to increase the rate of sinking , water and/or air from the tanks 18 and 20 is furnished to the piping network 14 in desired amounts and is forced therefrom through perforations 15 in the pipes. This causes a liquification of the soft soil directly above and below the piping network causing it to descend at an increased rate. As the piping network descends lower, the soft soil 10 above is consistently liquified and ultimately the network reaches the lower level which forms the upper surface of the subsurface strata 12 of hard soil or bedrock.

Figure 2:
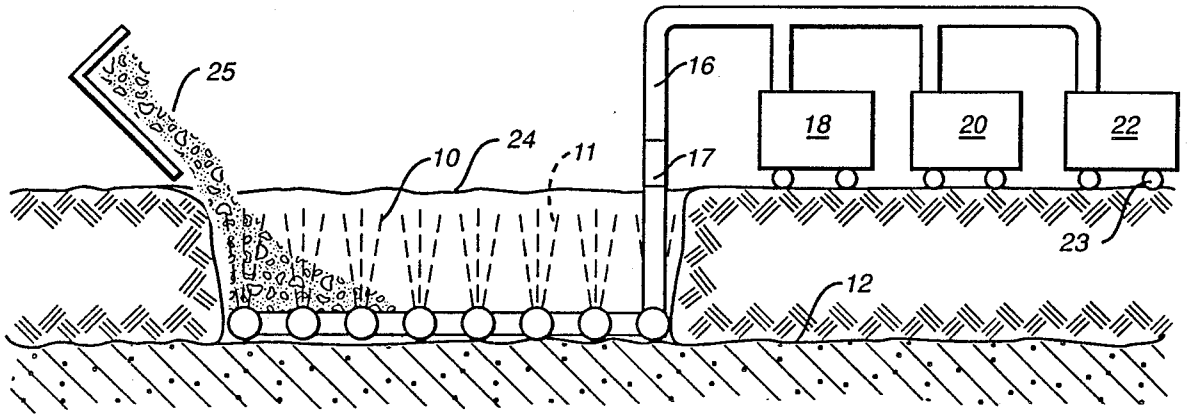
FIG 2 is a schematic view in cross-section, similar to FIG. 1, illustrating rock fragments completely filling the entire zone of liquefaction.

When the piping network 14 reaches the bedrock layer 12, the water and air supplies are continued. The upwardly directed air and water emitted from the perforations in the piping network cause a progressive liquefaction of the soil above, as shown in FIG. 1. When satisfactory liquefaction of the soft soil has been achieved, as shown in FIG. 2, rock fragments 25 of a preselected size are placed into the liquified soft soil 10 until the site is filled. The cementing chemical additives from the third tank 22 may also be supplied through the pipe network to fill voids between and around the rock fragments 25. Depending on the site condition, the rock fragments may be of various sizes, from relatively small crushed rock, larger gravel or much larger boulder size rock fragments (e.g. over 100 pounds). As the rock fragments are added, some of the native soil will be displaced and may be removed before chemical additives, such as cement, are supplied.

Figure 3:
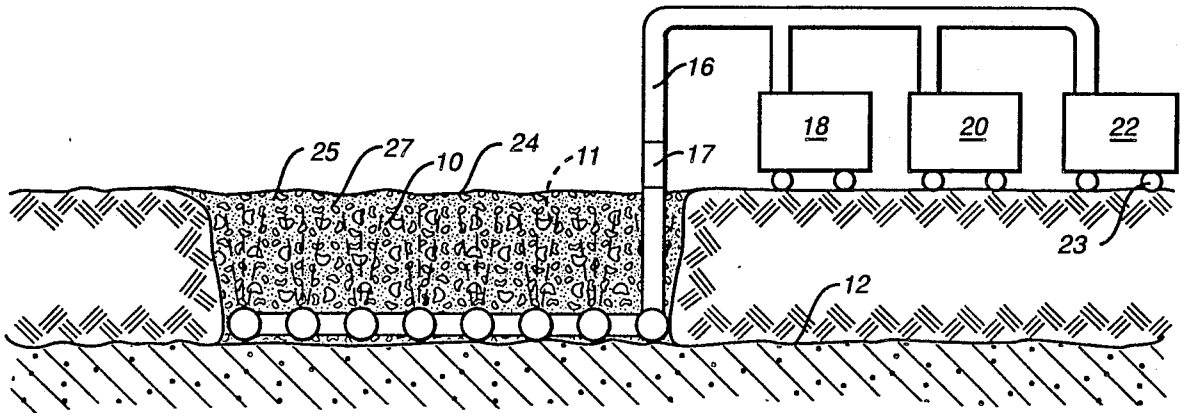
FIG. 3 is a schematic view, similar to FIG. 2, illustrating the step of filling void spaces created by the rock fragments with cementing chemical agents introduced by the liquefaction generator.
Figure 4:
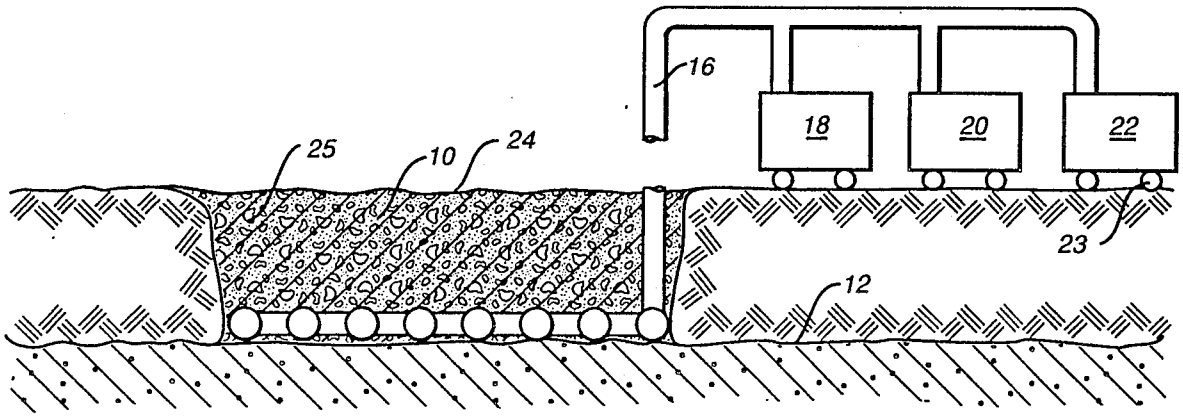
FIG. 4 is a schematic view showing a completed liquefied zone filled with rock fragments and with cementing chemical agents supplied through the liquefaction generator.

With the treatment site filled with rock fragments and the voids filled with the cementing agents 27 from tank 22, as shown in FIG. 3, a hardening process commences until the entire site becomes essentially a monolithic mass of hard material. Such a hardening period may take from about two to five weeks, depending upon various conditions, which is a relatively short period compared with the settlement time normally required by the prior "vertical drain" technique.

In some cases, sufficient rock fragments may be used to fill the entire liquefied zone to be mechanically densified and without filling the voids of the rock fragments. Here, the voids may be occupied by the native materials 10 without using any chemical additives.

Figure 5:
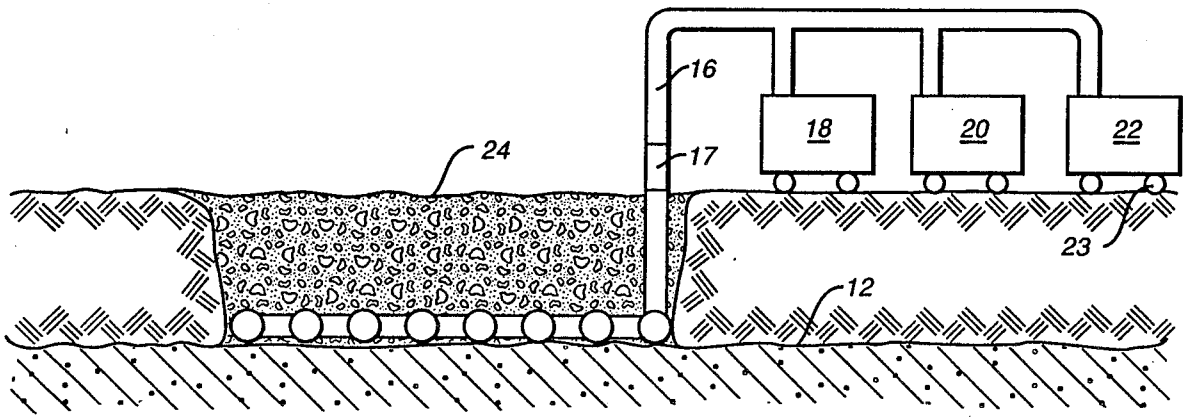
FIG. 5 is a schematic view in section, similar to FIG. 3, but with the entire liquefied zone filled with cementing chemical agents in lieu of rock fragments.

Provided the engineering characteristics of the native materials and the design requirements permit, subsequent to the liquefaction generator's descent to the desired position, and when all materials are in a state of liquefaction above the liquefaction generator 14, cementing chemical agents from the tank 22 may be supplied to and mixed with the native materials without any rock fragments, as schematically indicated in FIG. 5. Thereafter, the liquified mass with additives will solidify to form a subsurface load bearing mass.

Figure 6:
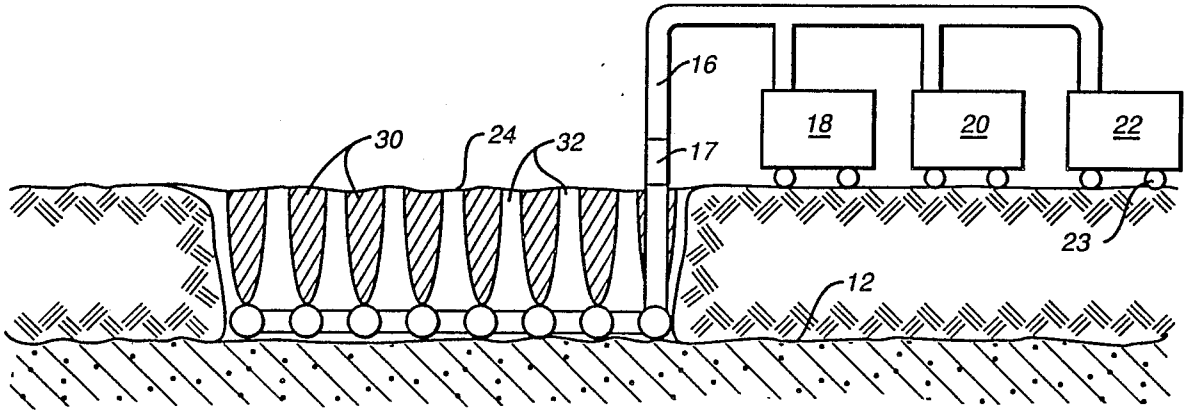
FIG. 6 is a schematic view in section, similar to FIG. 5, showing an embodiment of the invention wherein only spaced apart vertical zones are treated in accordance with the invention.

In some special cases where the design requirements are less stringent, vertical treatment zones 30 above each individual liquefaction generator pipe may be formed adjacent to other untreated zones 32 between them, as shown in FIG. 6. The various types of treatment (rock fragments with or without cementing agents or just cementing agents without rock fragments) will be dictated by the engineering properties of the native soil materials at the construction site and the design requirements of any proposed structure thereon.

The treatment methods presented herein could also be implemented below water surface (ocean, river, or lake), provided a suitable barrier is installed around the operation area to contain the turbid conditions which may be objectionable from an environmental point of view.

Deformation of treated zones implemented in accordance with the principles of this invention would be very much smaller than the zones treated in accordance with prior art practices, both during and after structural and/or seismic loadings.

Figure 7:
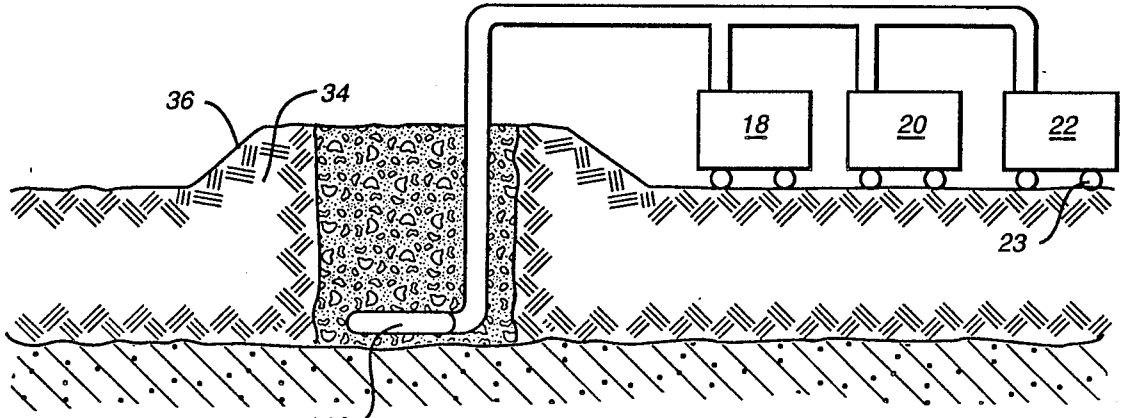
FIG. 7 is a schematic view in elevation and in section showing the apparatus for constructing a cutoff wall according to the present invention.
Figure 7A:
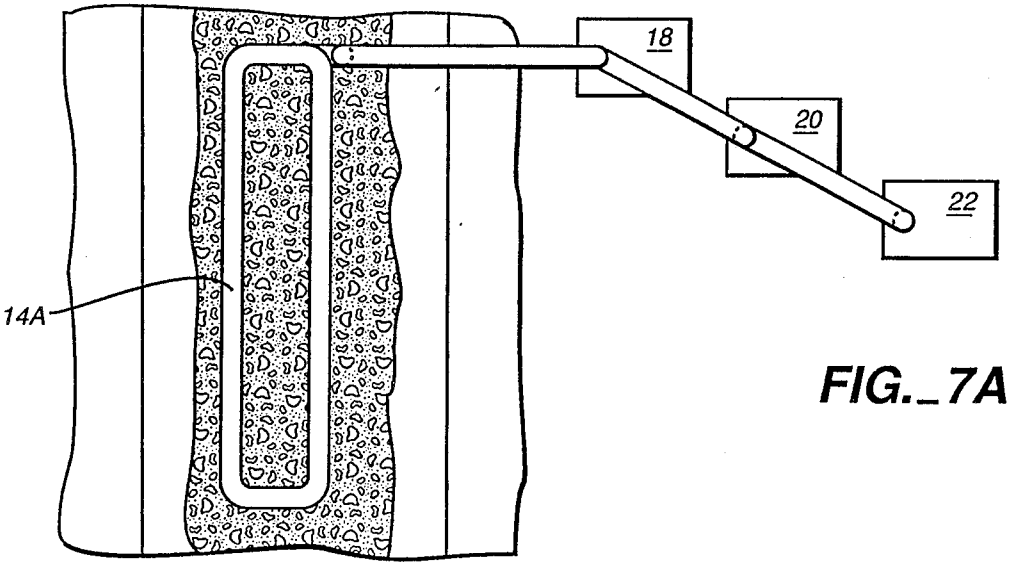
FIG. 7A is a plan view of the apparatus of FIG. 7.

Utilizing the principles of an artificially induced condition of soil liquefaction, a cutoff wall 34 or subsurface barrier could also be installed in various types of soils in accordance with the invention. As shown in FIGS. 7 and 7A, the width of the cutoff wall 34, which may be for an earth dike 36, is controlled by a selected number and spacing of a series of perforated pipes forming a liquefaction generator 14A. Here, the liquefaction generator 14A is installed within soft or sandy soil at the work site using the same method as previously described with respect to FIG. 1 and with the use of water and air from tanks 18 and 20. Subsequent to creating the condition of liquefaction to a desired depth, cementing agents from a tank 22 are supplied through the generator to be mixed with the native materials to be solidified to form the cutoff wall.

Figure 8:
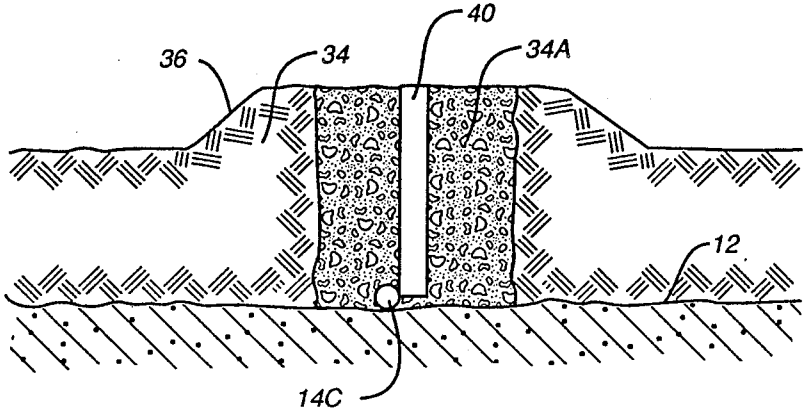
FIG. 8 is a schematic view in section showing another form of cutoff wall utilizing a vertical membrane installed in a liquefaction zone according to the invention.
Figure 8B:
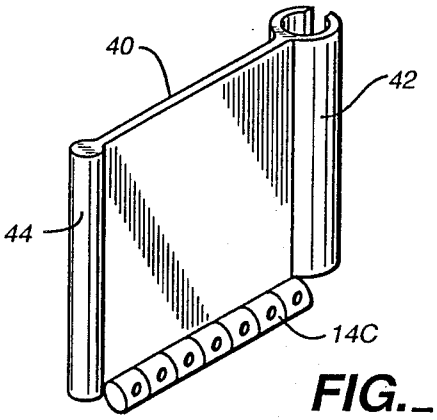
FIG. 8B is a view in perspective of the membrane shown in FIG. 8A.
Figure 8A:
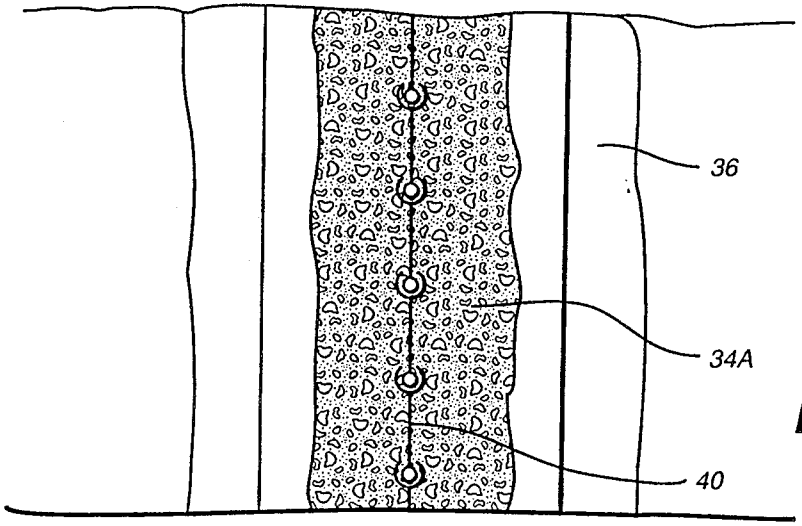
FIG. 8A is a plan view of the apparatus of FIG. 8.

FIGS. 8 and 8A show schematically a modified method of installing a cutoff wall 34A in existing levees or dikes 36 by first generating a condition of liquefaction and thereafter injecting cementing agents through the pipes as shown in FIG. 7. The width of the cutoff wall may be determined by the number of liquefaction generator pipes 14A as previously described. If an additional safeguard against seepage is required by the design, an impervious membrane 40 of sheet plastic or metal material could be installed in the liquified soil before it solidifies. If necessary, installation of the membrane may be speeded up by attaching a single liquefaction generator 14C at its bottom edge and activating the generator while lowering it into the desired position before solidification of the treated zone occurs. The membrane sheet 40 may be provided with mating tongue and groove portions 42 and 44 at its opposite ends as shown in FIG. 8B. When the membranes are connected, their joints can be grouted subsequent to their final positioning within the liquified soil to further assure water-tightness.

Figure 9:
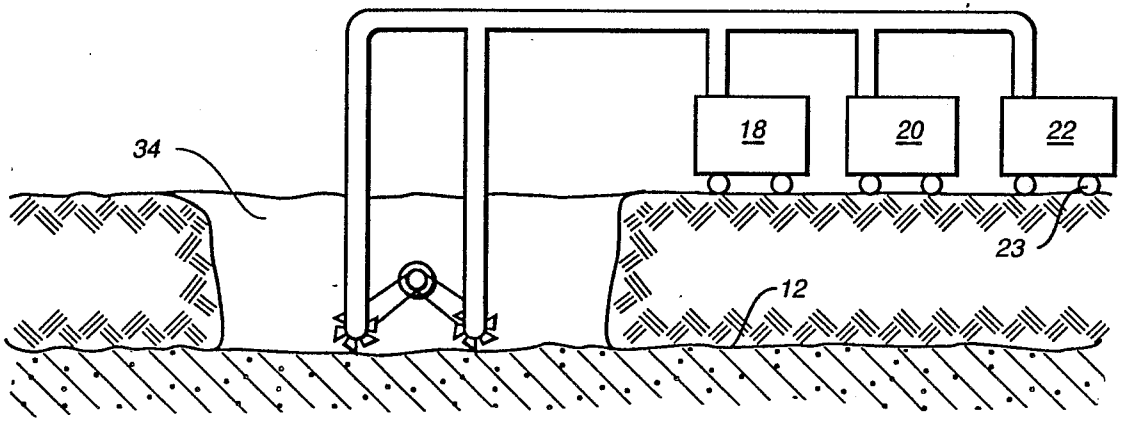
FIG. 9 is a schematic view in elevation and in section showing a liquefaction generator apparatus utilizing rotary cutters in accord with the present invention.
Figure 9A:
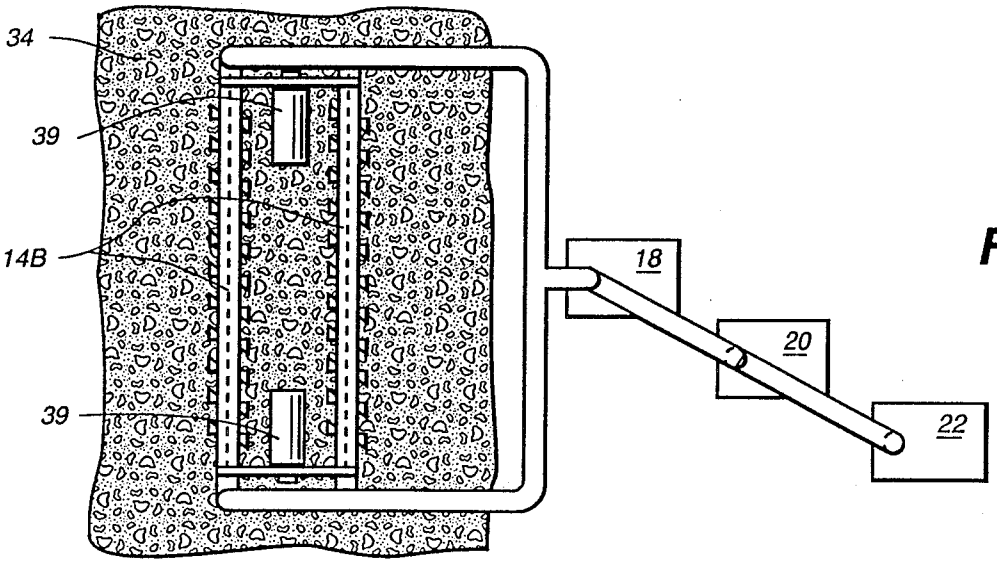
FIG. 9A is a schematic plan view of the apparatus of FIG. 9.

In a firm soil formation, as shown in FIGS. 9 and 9A, each of the individual liquefaction generator pipes may be replaced by perforated pipes to which are attached a plurality of small rotary cutting devices 38 having edges or points. Such rotary cutting devices, which are commercially available, may be attached to the exterior surface of the pipes so as to loosen up the soil as the liquefaction generator descends. Thus, as the generator descends, the rotary cutters combined with pressurized water and air through pipes 14B will cause a high level of soil liquefaction which may be necessary for areas of hardness or high soil viscosity. The rotation force for the cutting devices may be provided by electrical or hydraulic motors 39 which are drivingly attached to the pipes 14B. Using the powered soil cutting devices, such liquefaction generators will penetrate into the residual soil (soil produced by chemical weathering of rock surface insitu) and provide a "keying" effect with respect to its permeability. The process of installing the cutoff wall 34 in accordance with the invention is therefore relatively simple and expeditious compared with the methods of the prior art.

To those skilled in the art to which this invention relates, many changes in construction and widely differing embodiments and applications of the invention will suggest themselves without departing from the spirit and scope of the invention. The disclosure and the description herein are purely illustrative and are not intended to be in any sense limiting.

What is claimed is:

1. A method for forming a subsurface zone having an increased bearing capacity in a preselected area of relatively soft soil, comprising the steps of:

providing a liquefaction generator in the form of a plurality of interconnected perforated pipes forming a grid pattern which substantially extends over said preselected area of soft soil;

supplying air and water under pressure to said liquefaction generator while allowing the generator to sink within said soft soil to a subterranean layer of hard soil or rock;

continuing to supply air and water to said generator until the soil above it is in a state of liquefaction;

adding a quantity of hardenable material to the liquified soft soil above the generator; and allowing the mixed soil and added material to solidify over a period of time.

2. The method of claim 1 wherein said hardenable material is a Portland cement slurry.

3. The method of claim 1 wherein said hardenable material is supplied to the liquified soil through said liquefaction generator.

4. The method of claim 1 including the step of providing rotary cutter means on said liquefaction generator to facilitate its descent into a soft or sandy soil site.

5. The method of claim 1 wherein water and air is emitted from preselected pipes of said liquefaction generator to form vertical zones of soil liquefaction above said preselected pipes adjacent to zones of untreated soil.

6. The method as described in claim 1 including the step of adding rock fragments to the liquified soil above the liquefaction generator.

7. The method as described in claim 1 wherein said rock fragments include boulder sized fragments exceeding 100 pounds.

8. The method as described in claim 6 including the step of providing additional cementitious hardening material for filling voids between said rock fragments.

9. The method as described in claim 1 wherein said subsurface zone is formed as an impervious cutoff wall to provide an underground water barrier.

10. The method as described in claim 9 including the step of installing a sheet membrane within the liquified soil material before it solidifies to enhance the water barrier capacity of the underground cutoff wall.

11. The method as described in claim 10 wherein said sheet membrane is provided in sections having interlocking vertical edge members at opposite ends.

12. The method as described in claim 10 including the step of providing a means at the lower edge of said sheet membrane to facilitate its passage downwardly through liquified soil and thus its installation within the cutoff wall.

13. A liquefaction generator for use in forming a zone of increasing bearing strength in relatively soft soil, said generator comprising:

a plurality of pipes interconnected to form a predetermined grid pattern, a selected number of said pipes having wall perforations;

inlet means connected to said pipes;

a water supply means;

an air pressure supply means;

a chemical additive supply means;

means connecting all of said supply means to said inlet means; and valve means for supplying water and air under pressure to said pipes so that such fluids can be emitted through said perforations and thereby enable said generator to sink into said soft soil and thereafter cause its liquefaction.

14. The liquefaction generator as described in claim 13 wherein said means connecting said supply means to said inlet means includes at least one vertically slidable pipe section which is extendable as the pipe grid pattern descends within the soft soil.

15. The liquefaction generator as described in claim 13 including a plurality of rotary soil cutters attached to some of the pipes of said grid pattern for loosening the soil and further facilitating the downward movement of the generator.

* * * * *